United States Patent [19]

Gilbert et al.

[11] 4,329,246

[45] May 11, 1982

[54] ALKALINE DISHWASHER DETERGENT

[75] Inventors: Lawrence A. Gilbert, Fairfield; Robert A. Staab, Cincinnati; Royal D. Collins, Bethel; Charles R. Ries, Cincinnati, all of Ohio

[73] Assignee: The Procter & Gamble Company, Cincinnati, Ohio

[21] Appl. No.: 849,132

[22] Filed: Nov. 7, 1977

[51] Int. Cl.[3] ..... C11D 7/56

[52] U.S. Cl. ..... 252/103; 252/95; 252/99; 252/187 H; 252/187 C; 8/108 R

[58] Field of Search ..... 252/103, 95, 99, 187 H, 252/187 C; 8/108 R

[56] References Cited

U.S. PATENT DOCUMENTS

| | | | |
|---|---|---|---|
| 3,598,743 | 8/1971 | Coates | 252/99 |
| 3,600,371 | 8/1971 | Lintner | 252/99 |
| 3,630,923 | 12/1971 | Simmons et al. | 252/99 |
| 3,656,890 | 8/1972 | Toy | 252/99 |
| 3,696,041 | 10/1972 | Gray | 252/99 |

*Primary Examiner*—Mayer Weinblatt

*Attorney, Agent, or Firm*—Robert B. Aylor; Richard C. Witte; Thomas H. O'Flaherty

[57] ABSTRACT

Alkaline dishwasher detergent composition having a specific critical pH, and a relatively high level of available chlorine, buffered with trisodium phosphate, containing a tripolyphosphate or pyrophosphate sequestering builder, and having a relatively high level of surfactant. The detergent composition is substantially free of highly alkaline materials and organic builders and preferably contains 2.0r alkali metal silicate and/or a preferred $C_{17}$–$C_{19}$ polyethoxylate surfactant.

16 Claims, No Drawings

ALKALINE DISHWASHER DETERGENT

CROSS-REFERENCE TO RELATED APPLICATIONS

This application is related to the copending applications of Halas et al., Ser. No. 849,131, filed concurrently herewith and Barford et al., Ser. No. 849,206, filed concurrently herewith, which are incorporated herein by reference.

BACKGROUND OF THE INVENTION

This invention relates to detergent compositions which are particularly suitable for use in automatic dishwashers. Such compositions are normally alkaline, contain low levels of low foaming surfactants, and contain a source of available chlorine. In order to obtain good cleaning performance, the disclosed compositions usually contain a source of alkalinity which gives a pH greater than 12 at a 1% concentration or large amounts of phosphate builders or organic builders. However, it is known that sources of alkalinity such as alkali metal metasilicates and alkali metal hydroxides are relatively unsafe for inclusion in large amounts in a consumer product. Also, it is desirable to try to lower the amount of phosphorus contained in such compositions.

SUMMARY OF THE INVENTION

This invention is based upon the discovery that a series of modifications in conventional, automatic dishwasher compositions can give surprisingly superior cleaning and spotting and filming results while increasing the safety of the compositions and lowering the amount of phosphorus required for a given level of performance. More specifically, this invention relates to automatic dishwasher compositions providing optimum cleaning and spotting and filming characteristics consisting essentially of:

(1) from about 20% to about 50%, preferably from about 20% to about 30%, of a sequestering builder selected from the group consisting of alkali metal tripolyphosphates and pyrophosphates, and mixtures thereof;

(2) from about 8% to about 20% trisodium phosphate;

(3) from about 5% to about 20%, preferably from about 9% to 15%, of $SiO_2$ as an alkali metal silicate having an $SiO_2$:$M_2O$ ratio (wherein M is sodium or potassium, preferably sodium) of from about 1.6 (1.6r) to about 3.3, preferably from about 2 to about 3.2, most preferably a mixture of 2.0r and 3.2r silicates and yet more preferably containing at least some anhydrous 2.0r silicate;

(4) available chlorine at a level of from about 1.0% to about 3%, preferably from about 1.25% to about 2.5%; and (5) from about 2.5% to about 15%, preferably from about 3% to about 10%, most preferably from about 5% to 8%, of a low foaming nonionic surfactant which is preferably a $C_{17}$–$C_{19}$ alcohol, preferably having a pure chain length, most preferably $C_{18}$, condensed with from about 6 to about 15 moles, preferably from about 7 to about 12 moles, most preferably 9 moles, of ethylene oxide per mole of fatty alcohol, and preferably having a very tight ethoxylate distribution, said composition having a pH of from about 10.5 to 11.2 at 2,500 ppm and being substantially free, i.e., less than about 10%, preferably less than about 5%, and most preferably entirely free of materials having a pH of 12 or more at a concentration of 1% in water and also being substantially free, i.e., less than about 10%, preferably less than 5% and most preferably completely free of organic chelating builders.

The above compositions give superior cleaning and improved spotting and filming characteristics using less phosphorus and less very highly alkaline materials than is required by the prior art to give equivalent levels of performance.

DETAILED DESCRIPTION OF THE INVENTION

The Phosphate Sequestering Agent

It has been found that at least 20% of the composition must be either sodium or potassium tripolyphosphate or sodium or potassium pyrophosphate or mixtures thereof in order to provide good cleaning and spotting and filming (S/F) results. Since it is desirable to keep the phosphorus content of the composition as low as possible, it is preferred to use a level of from about 20% to about 30% of these sequestering phosphate builders although increased levels up to 50% provide performance benefits. As the amount of sequestering phosphate builder is reduced below about 20%, the level of performance drops off drastically. In general, one would like to use as much of the sequestering phosphate builder as possible given the limits that are permitted in formulation. The preferred builder is sodium tripolyphosphate.

In addition to serving as a sequestering builder, the sequestering phosphate builder also is a source of alkalinity and a buffering material. It also is a major source of hydration capacity which assists in making the composition free-flowing initially and maintaining the free-flowing characteristics during storage.

The Trisodium Orthophosphate

The composition must contain at least about 8% and up to about 20% of trisodium orthophosphate either as trisodium orthophosphate or as chlorinated trisodium orthophosphate. The trisodium phosphate is a unique buffering material which provides the relatively high alkaline pH in use that is required for optimum performance while still maintaining the safety of the composition at the highest possible level.

The term "chlorinated trisodium phosphate" designates a composition consisting of trisodium phosphate and sodium hypochlorite in intimate association in the crystalline form. The chlorinated trisodium phosphate can contain from 1% to 5% available chlorine calculated on the basis of the hydrated material and can conveniently be prepared by the methods of U.S. Pat. Nos. 1,555,474 or 1,965,304 or modifications thereof, incorporated herein by reference. It is preferable to use the trisodium phosphate as the chlorinated trisodium phosphate. If one does not use the chlorinated trisodium phosphate, it is usually necessary to incorporate an organic chlorine bleach component. Also, it is desirable to keep the amount of extraneous organic material in the composition as low as possible.

The Source of Available Chlorine

The source of available chlorine is a chlorine bleach component, a compound which contains chlorine in active form. Such compounds are often characterized as hypochlorite compounds and are well known as a class. It has been found that the compositions of this invention should have a source of available chlorine in an amount sufficient to provide available chlorine equal to about 1% to about 3% by weight of the composition. A more preferred level is from about 1.25% to about 2.5% by weight of the composition. It has been found that the high level of available chlorine is required both for good cleaning, especially on starchy soils, and for good S/F.

As stated before, the preferred source of available chlorine is chlorinated trisodium phosphate. However, other materials which can be used are: sodium and potassium dichlorocyanurates, dichlorocyanuric acid; 1,3-dichloro-5,5-dimethyl hydantoin; N,N'-dichlorobenzoylene urea; paratoluene sulfondichloroamide; trichloromelamine; N-chloroammeline; N-chlorosuccinimide; N,N'-dichloroazodicarbonamide; N-chloroacetyl urea; N,N'-dichlorobiuret; chlorinated dicyandiamide; sodium hypochlorite; calcium hypochlorite; and lithium hypochlorite. Of the other materials sodium, and especially potassium dichlorocyanurates are preferred for effectiveness, stability, availability, etc.

Other advantages for the high level of available chlorine will be apparent from the discussion hereinafter.

The Silicate

The compositions of this invention contain from about 5% to about 20%, preferably from about 9% to about 15%, of $SiO_2$ as a sodium or potassium silicate, preferably a sodium silicate having a ratio of $SiO_2$:$Na_2O$ of from about 1.6 to about 3.3, most preferably from about 2 to about 3.2. It is been found, surprisingly, that two ratio (2.0r) silicate is optimum for best overall performance as far as S/F is concerned on metal surfaces. However, in order to provide good materials protection, it is desirable to have at least 10% and up to 50% of the $SiO_2$ present as some higher ratio silicate, preferably a 3.2r silicate in the composition. The ratio of $SiO_2$ as 2.0r silicate to $SiO_2$ in the higher ratio silicate ($\geqq$2.6r), e.g., 3.2r, is from about 10:1 to about 1:1 preferably from about 6:1 to about 4:1. It is also been surprisingly found that it is desirable to have at least some of the 2.0r silicate in anhydrous form to provide alkalinity and superior physical properties, e.g., less caking and better flow properties.

The Surfactant

It is been found, surprisingly, that at least about 2.5%, and up to about 15%, of a low sudsing surfactant is required in order to provide optimum cleaning and S/F (spotting and filming characteristics). Care, however, must be taken that the surfactant level is not so high as to cause over-sudsing problems. A preferred level of surfactant is from about 3% to about 10% and an even more preferred level of surfactant is from about 5% to about 8% by the weight of the composition. Preferably, the surfactant is a conventional alkoxylated, preferably ethoxylated, nonionic surfactant and preferably the composition is essentially free of sulfonated or sulfated anionic surfactants.

Examples of nonionic surfactants include:

(1) the condensation product of 1 mole of a saturated or unsaturated, straight or branched chain, alcohol or fatty acid containing from about 10 to about 20 carbon atoms with from about 4 to about 50 moles of ethylene oxide. Specific examples of such compounds include a condensation product of 1 mole of coconut fatty acid or tallow fatty acid with 10 moles of ethylene oxide; the condensation of 1 mole of oleic acid with 9 moles of ethylene oxide; the condensation product of 1 mole of stearic acid with 25 moles of ethylene oxide; the condensation product of 1 mole of tallow fatty alcohols with about 9 moles of ethylene oxide; the condensation product of 1 mole of oleyl alcohol with 10 moles of ethylene oxide; the condensation product of 1 mole of $C_{19}$ alcohol and 8 moles of ethylene oxide; and the condensation product of one mole of $C_{18}$ alcohol and 9 moles of ethylene oxide.

It has, surprisingly, been found that the condensation product of a fatty alcohol containing from 17 to 19 carbon atoms, and being substantially free of chain lengths above and below these numbers, with from about 6 to about 15 moles, preferably 7 to 12 moles, most preferably 9 moles, of ethylene oxide provides superior S/F performance. More particularly, it is desired that the fatty alcohol contain 18 carbon atoms and be condensed with from about 7.5 to about 12, preferably about 9, moles of ethylene oxide. It is even more desirable if the distribution of ethylene oxide condensation products is such as to give more than about 40%, preferably more than about 50% of the product within plus or minus two ethylene oxide moieties from the average. The preferred product contains less than about 2% unethoxylated alcohol and more than about 70% should contain less than about 10 ethoxy moieties. This distribution of ethylene oxide analogs can be obtained by using a high level of a very strong alkaline catalyst such as sodium metal or sodium hydride in e.g., a 1:1 molar ratio of catalyst to alcohol or by stripping a conventional ethoxylated alcohol. These various specific $C_{17}$–$C_{19}$ ethoxylates give extremely good performance even at lower levels (e.g., 2.5%–3%) and at the higher levels (>5%) are sufficiently low sudsing, especially when capped with a low molecular weight ($C_{1-5}$) acid or alcohol moiety, so as to minimize or eliminate the need for a suds-suppressing agent. This is highly desirable since suds-suppressing agents in general tend to act as a load on the composition and to hurt long term S/F characteristics.

(2) Polyethylene glycols having molecular weights of from about 1,400 to about 30,000, e.g., 20,000; 9,500; 7,500; 6,000; 4,500; 3,400; and 1,450. All of these materials are waxlike solids which melt between 110° F. and 200° F.

(3) The condensation products of 1 mole of alkyl phenol wherein the alkyl chain contains from about 8 to about 18 carbon atoms and from about 4 to about 50 moles of ethylene oxide. Specific examples of these nonionics are the condensation products of 1 mole of decylphenol with 40 moles of ethylene oxide; the condensation product of 1 mole of dodecyl phenol with 35 moles of ethylene oxide; the condensation product of 1 mole of tetradecylphenol with 25 moles of ethylene oxide; the condensation product of 1 mole of hectadecylphenol with 30 moles of ethylene oxide, etc.

(4) Polyoxypropylene, polyoxyethylene condensates having the formula $HO(C_2H_4O)x(C_3H_6O)y\ (C_2H_4O)x\ H$ where y equals at least 15 and $(C_2H_4O)x+x$ equals 20% to 90% of the total weight of the compound and the molecular weight is from about 2,000 to about 10,000, preferably from about 3,000 to about 6,000. These materials are, for example, the Pluronics which are well known in the art.

(5) The compounds of (1) which are capped with propylene oxide, butylene oxide and/or short chain alcohols and/or short chain fatty acids, e.g., those containing from 1 to about 5 carbon atoms, and mixtures thereof.

Preferred surfactants are those having the formula $RO\text{-}(C_2H_4O)_xR^1$ wherein R is an alkyl or alkylene group containing from 17 to 19 carbon atoms, x is a number from about 6 to about 15, preferably from about 7 to about 12, and $R^1$ is selected from the group consisting of: preferably, hydrogen, $C_{1-5}$ alkyl groups, $C_{2-5}$ acyl groups and groups having the formula $-(C_yH_{2y}O)_nH$ wherein y is 3 or 4 and n is a number from one to about 4.

Also preferred are the low sudsing compounds of (4), the other compounds of (5), and the $C_{17-19}$ materials of (1) which have a narrow ethoxy distribution.

In addition to the above mentioned surfactants, other suitable surfactants can be found in the disclosures of U.S. Pat. Nos. 3,544,473, 3,630,923, 3,888,781 and 4,001,132, all of which are incorporated herein by reference.

Other ingredients

In addition to the above ingredients it may be desirable, if the product sudses too much, to incorporate one of the many suds-suppressing ingredients disclosed in the above mentioned patents which have been incorporated by reference at a level of from about 0.001% to about 10%, preferably from about 0.05% to about 3%. The preferred suds suppressing materials are mono- and distearyl acid phosphates; the self-emulsified siloxane suds-suppressors of pending U.S. patent application Ser. No. 841,078, filed Oct. 11, 1977, by T. W. Gault and Edward John McGuire, Jr. and mixtures thereof. In general, lower amounts of, or no, suds-suppressors are preferred. Less than 0.2%, preferably less than 0.1% is desirable, more preferably none for best S/F, long term.

The compositions should contain less than about 10%, preferably less than about 5%, preferably none of materials which have a pH greater than 12 at a concentration of 1% in water. Such materials are conventional components of automatic dishwashing compositions such as sodium metasilicate and sodium hydroxide. The content of such materials should be kept to the bare minimum for safety reasons.

Similarly, there should be no more than about 10%, preferably no more than about 5% and preferably no organic sequestering builders in the compositions. As shown hereinafter, the presence of organic builders hurts the S/F performance of these compositions.

China protecting agents including aluminosilicates, aluminates, etc., may be present in amounts of from about 0.1% to about 5%, preferably from about 0.5% to about 2%.

Filler materials can also be present including sucrose, sucrose esters, sodium chloride, sodium sulfate, etc., in amounts from about 0.001% to about 60%, preferably from about 5% to about 30%.

Hydrotrope materials such as sodium benzene sulfonate, sodium toluene sulfonate, sodium cumene sulfonate, etc., can be present in minor amounts, but, as with other organic materials, their presence is normally minimized.

Dyes, perfumes, crystal modifiers and the like can also be added in minor amounts.

As used herein, all percentages, parts and ratios are by weight unless otherwise stated.

The following Examples illustrate the invention and facilitate its understanding.

DEMONSTRATIVE EXAMPLE I SHOWING ORGANIC BUILDER EFFECTS

| | BUILDER | | | | | |
|---|---|---|---|---|---|---|
| Composition | Sodium Carboxymethyl-oxymalonate | Sodium Citrate | Sodium Carboxymethyl Oxysuccinate | Sodium Oxy-disuccinate | Sodium Nitrilotri-acetate | Sodium Tri-polyphosphate |
| Builder | 30 | 15 | 50 | 50 | 50 | 50 |
| Tallow fatty alcohol with 9 moles of ethylene oxide | 6 | 6 | 6 | 6 | 6 | 6 |
| Suds suppressant (DB544 - a product of the Dow Chemical Company - a self-emulsified siloxane suds suppressor) | .3 | .3 | .3 | .3 | .3 | .3 |
| Sodium or potassium di-chloroiso/anurate (NaOCC/KDCC) | 3.5 | 3.5 | 3.5 | 3.5 | 3.5 | 3.5 |
| Sodium silicate (2.0r hydrous) | 25 | 25 | 25 | 25 | 25 | 25 |
| Sodium sulfate | 35.2 | 50.2 | 15.2 | 15.2 | 15.2 | 15.2 |
| Differences between S/F grades for the above formulas v. S/F grades for a standard commercial product in a full-scale washer w/15 gr. $H_2O$ at 130° F. at 2,500 ppm concentration (spotting/filming) | −1.3/−1.0 | −.8/−1.0 | −.1/−.9 | −2.7/−1/4 | −1.9/+0.1 | +.1/+.4 |

The above differences in spotting/filming grades are significant at the 10% risk level. The full-scale spotting and filming results and cleaning results were obtained herein using the following tests:

Spotting/Filming

Four test glasses (Libbey Safe Edge 10 oz. tumblers No. 553) were added in predetermined (the same for all tests) positions in the upper rack. Prior to placement in the machine, two of the test glasses were soiled with a thin film of milk by coating them with refrigerated whole milk. Thirty-five grams of 4:1 weight mixture of shortening and dry milk were placed in a 50 ml. beaker and inverted in the top rack of the dishwasher. The required amount of detergent product was then added to the dispenser cup. The test consisted of four washer cycles conducted in three types of dishwashers whereby four glasses from each dishwasher were graded at the end of the 2nd, 3rd and 4th cycles. The levels of spotting and filming performance were appraised with the aid of a 1-10 scale of photographic standards (separate standards for spotting and filming) wherein 1 represents a completely unacceptable level of performance and 10 represents a performance whereby residual spotting and filming do not occur. The seventy-two grades (thirty-six spotting; thirty-six filming) so obtained are averaged to determine average spotting and filming grades.

Cleaning

Fried sausages and eggs were blended, spread on four plastic plates, and air dried (protein/grease soil); cooked rice was smeared over four china plates, the excess removed and air dried (starch soil); and hamburgers were cooked in four Corning Ware pans, and the hamburgers were removed (protein/grease soil). These constitute a set of dishes.

A set of dishes is placed in each of two machines and washed with two test product, and then using dishes from the same set each product is tested in the other washer. The dishes are graded on a 1-4 scale with 0 equal to clean and −4 equal to a dirty dish.

Although the above results were not obtained with all of the essential ingredients and limits of the compositions of the present invention, the same kind of results are obtained when the above builders are incorporated into the detergent composition of this invention. All of the organic builder materials hurt the S/F performance of automatic dishwasher detergent compositions. This has not been recognized before and, in fact, the prior art, in general, teaches the desirability of organic detergency builders. Although it is true that such builders are very good as far as cleaning performance is concerned, in every instance they have been found to hurt the spotting/filming performance of automatic dishwasher compositions.

DEMONSTRATIVE EXAMPLE II SHOWING EFFECT OF pH AT LOW AVAILABLE CHLORINE

In this Example the standard composition containing about 45% sodium tripolyphosphate, about 22% chlorinated trisodium phosphate, about 15% of a 47% solids 2.6r sodium silicate, about 15% of a 43% soilids 3.2r sodium silicate and about 2.7% of a low sudsing nonionic surfactant (Pluradot HA433) which is a condensation product of propylene glycol with propylene oxide and then with polyethylene oxide to have a molecular weight of about 3,700–4,200 (26% polyethylene oxide) and containing 3% monostearyl acid phosphate (0.08% in product) as a suds suppressor for use. This composition had a pH of about 10 under use conditions (2,500 ppm concentration). To this basic composition were added sufficient amounts of sodium hydroxide to give pHs of 10.8, 11.2, 11.4, 11.6, respectively.

These compositions were tested according to a procedure in which microscope slides were soiled with egg protein/grease soils on four replicate slides; the slides were dried in a 90° F. oven for about an hour; the slides were placed in a 600 milliliter beaker containing 300 milliliters of the solution containing the compositions at a level, based on the standard composition, of about 2,500 milligrams per liter; and the beaker was placed in a constant temperature bath and stirred slowly for 5 minutes; the slides were then removed and dipped in rinse water 3 times and allowed to air dry; and the % of protein/grease soil removed is analyzed by obtaining Haze measurements using a Hunter Color Difference Meter. The water in this test was at 130° F. and the hardness was 2 grains per gallon.

The test results were as follows:

| pH | 10 | 10.8 | 11.2 | 11.4 | 11.6 |
|---|---|---|---|---|---|
| % protein soil removal | 86 | 88 | 89 | 61 | 32 |

Although the above compositions do not contain the appropriate amount of available chlorine they do demonstrate very clearly the effect of pH with respect to the indicated protein soil. Surprisingly, as one goes past, approximately, pH 11.2 to pH 11.4, the performance drops abruptly on protein soils.

In full scale cleaning tests (1) a benefit in protein removal was shown for pH 10.7 over pH 10 and (2) no appreciable improvement in starch removal was obtained until a pH of about pH 11.5 was reached. These tests were run with the low level of available chlorine of this test.

EXAMPLE III

The base formula of Example II was modified by first adding 0.7% sodium hypochlorite, then by adding 3.6% sodium hydroxide and 0.7% sodium hypochlorite, and then by adding 3.5% of sodium hydroxide and 2% sodium hypochlorite. These formulas were then compared against the standard formula using both starch and protein/grease soils in a full scale cleaning test. The first composition (base) having a pH of 10 and 0.7% available chlorine, removed 15% of the starch soil, and 31% of the protein/grease soil. When 0.7% sodium hypochlorite was added so that the composition had a pH of 10 and 1.4% available chlorine, the percentage removals were 15% and 33%, respectively, showing essentially no improvement. However, when 3.6% sodium hydroxide was added so that the third product had a pH of 10.7 and available chlorine of 1.4%, the percentage removals were 30% and 56%, respectively. In the fourth product where the pH was 10.7 and the available chlorine was 2.8%, the percentage removals were 60% and 74%, respectively. In this example, it is clearly demonstrated that increasing the available chlorine level is only beneficial at applicants' particular pH level. Applicants' limits must be met to provide both good protein and starch removal. Both cannot be obtained either by increasing the available chlorine or by modifying the pH alone. It is only the combination of the two modifications that gives good performance on both soils.

EXAMPLE IV

The following are compositions demonstrating the effectiveness of this invention.

| | A | B |
|---|---|---|
| Sodium tripolyphosphate | 22.0% | 26.5% |
| Chlorinated trisodium phosphate | 40.0% | 22.1% |
| Sodium silicate (2.0r) (46% total solids) | 10.0% | |
| Sodium silicate (2.6r) (47% total solids) | | 9.85% |
| Sodium silicate (3.2r) (39% and 43% total solids respectively) | 13.0% | 9.85% |
| Sodium silicate (2.0r-anhydrous) | 5.0% | 4.6% |

-continued

| | A | B |
|---|---|---|
| HA-430 (HA-433 without phosphate suds-suppressant) | 5.0% | — |
| HA-433 | 3.0% | 5.5% |
| Sodium carbonate | 2.0% | — |
| Sodium sulfate | — | 21.6% |
| pH at 2,500 ppm concentration in $H_2O$ | 10.8 | 10.0 |
| Available chlorine | 1.4% | 0.7% |
| | (PSU*/Percent Removal - Full Scale Cleaning) | |
| Starch soil | −.3/20.0% | −1.7/11.0% |
| Protein soil | −0.7/74.0% | −2.0/35.0% |

*PSU, as used, herein refers to Panel Score Units resulting from visual grading according to the rating systems disclosed herein.

As can be seen from the above, Composition A within the scope of this invention, having the required pH and available chlorine content is highly superior to a very similar composition which is modified only slightly to have a very slightly lower pH and slightly lower available chlorine content.

EXAMPLE V

Composition A from Example IV was modified by replacing 5.0% of HA-430 and 0.5% of HA-433 with $Na_2SO_4$. The full scale S/F results were as follows: The test was run with 9 machines and the hardness was 6.9 grains/gallon.

| | Spotting/filming |
|---|---|
| A | 8.6/8.6 |
| low surfactant A | 7.5/8.1 |

These were statistically significant differences in favor of the higher level of surfactant.

EXAMPLE VI

Example V was repeated, substituting the condensation product of one mole of an essentially pure $C_{18}$ fatty alcohol with nine moles of ethylene oxide using a 1:1 molar ratio of Na metal catalyst to fatty alcohol for the HA 430 and/or HA 433. The condensation product had less than about 2% unethoxylated fatty alcohol, more than 70% having 10 or less ethylene oxide moieties and more than 50% of the product having from about 7 to about 11 ethylene oxide moieties per molecule. The full scale S/F results were as follows:

| | Spotting/Filming |
|---|---|
| High surfactant formula | 8.3/8.6 |
| Low surfactant formula | 7.2/7.7 |

This relatively biodegradable surfactant was sufficiently low sudsing to be used with 0.1% monostearyl acid phosphate suds suppressor at higher levels to provide good S/F results.

EXAMPLE VII

The A composition of Example IV was modified by replacing the 3.2r silicate with 2.0r silicate and compared to the base formula of Example I for S/F using stainless steel pots and knives in a full scale test modified by using a 0–4 grading scale in which 0 is extremely spotty and 4 is no spots.

The protein/grease soil of Example I was used. The modified A composition had S/F average grades of 3.2 and 3.1 for the pots and knives respectively versus grades of 2.2 and 2.2 for the more conventional base formula of Example I. This is a statistically significant difference in favor of the 2.0r silicate and clearly demonstrates the improvement in S/F grades on metal available with 2.0 ratio silicate as opposed to higher (2.6r–3.2r) ratio silicates.

When in the above Examples, the following surfactants are substituted for the indicated surfactants substantially equivalent results are obtained: Plurafac RA-40 (a C13.3 linear alcohol ethoxylated with about 3.86 moles of ethylene oxide and the condensation product thereof reacted with about 9 moles of propylene oxide); a mixture of 14 and 15 carbon alcohols ethoxylated with 17 moles of ethylene oxide and then propoxylated with 3 moles of propylene oxide; a mixture of $C_{12}$ and $C_{13}$ alcohols ethoxylated with 6 moles of ethylene oxide and then propoxylated with 6 moles of propylene oxide; a mixture of $C_{14}$ and $C_{15}$ fatty alcohols ethoxylated with 12 moles of ethylene oxide and then propoxylated with 6 moles of propylene oxide; a $C_{15}$ alcohol ethoxylated with 9 moles of ethylene oxide and then capped with a methyl group; polyethylene glycol having a molecular weight of about 4,000; and stearic acid condensed with about 9 moles of ethylene oxide.

When in the above Examples, sodium or potassium pyrophosphate is substituted for the sodium tripolyphosphate substantially equivalent results are obtained.

What is claimed is:

1. An automatic dishwashing composition providing optimum cleaning and spotting and filming characteristics consisting essentially of:

(1) from about 20% to about 50% of a sequestering builder selected from the group consisting of alkali metal, tripolyphosphates and pyrophosphates;

(2) from about 8% to about 20% trisodium phosphate;

(3) from about 5% to about 20% of $SiO_2$ as an alkali metal silicate having an $SiO_2$:$M_2O$ ratio of from about 1.6 to about 3.3, wherein M is selected from the group consisting of sodium and potassium;

(4) available chlorine at a level of from about 1% to about 3%; and (5) from about 2.5% to about 15% of a low foaming nonionic surfactant said composition having a pH of from about 10.5 to 11.2 at 2,500 ppm and being completely free of materials having a pH of 12 or more at a concentration of 1% in water and being substantially free of organic chelating builders.

2. The composition of claim 1 which is completely free of organic chelating builders.

3. The composition of claim 2 containing available chlorine at a level of from about 1.25% to about 2.5%.

4. The composition of claim 3 containing from about 9% to about 15% of $SiO_2$ as sodium silicate.

5. The composition of claim 3 containing from about 20% to about 30% of sodium tripolyphosphate.

6. The composition of claim 3 wherein the available chlorine is added by way of a sodium or potassium dichloroicynurate.

7. The composition of claim 3 containing from about 3% to about 10% of a low foaming nonionic surfactant.

8. The composition of claim 7 containing from about 5% to about 8% of a low foaming nonionic surfactant.

9. The composition of claim 3 wherein the trisodium orthophosphate is in the form of chlorinated trisodium phosphate.

10. The composition of claim 9 wherein the nonionic surfactant is present at a level of from about 3% to about 10%.

11. The composition of claim 10 wherein the nonionic surfactant is present at a level of from about 5% to about 8%.

12. The composition of claim 1 containing from about 3% to about 10% of the low foaming nonionic surfactant.

13. The composition of claim 12 wherein the low foaming nonionic surfactant is present at a level of from about 5% to about 8%.

14. The composition of claim 12 containing from about 9% to about 15% of $SiO_2$ as sodium silicate.

15. The composition of claim 12 containing available chlorine at a level of from about 1.25% to about 2.5%.

16. The composition of claim 15 wherein the trisodium orthophosphate is present as chlorinated trisodium phosphate.

* * * * *